US005234725A

United States Patent [19]

Smith

[11] Patent Number: 5,234,725

[45] Date of Patent: Aug. 10, 1993

[54] WRIST POMPON STRUCTURE

[76] Inventor: Catherine L. Smith, 1411 S. Tacoma, Kennewick, Wash. 99337

[21] Appl. No.: 907,592

[22] Filed: Jul. 2, 1992

[51] Int. Cl.[5] ..... D04D 7/06

[52] U.S. Cl. ..... 428/4; 2/162; 2/170; 28/147; 428/28

[58] Field of Search ..... 2/162, 170; D21/100; 28/147; 428/4, 28

[56] References Cited

U.S. PATENT DOCUMENTS

| | | | |
|---|---|---|---|
| 215,671 | 5/1879 | Quosbarth | 2/170 |
| 277,609 | 5/1883 | Remington | 28/147 X |
| D. 284,487 | 7/1986 | Pratt | D21/100 |
| 615,389 | 12/1898 | Heagle et al. | 2/170 |
| 1,896,060 | 1/1933 | Colby | 428/28 |
| 3,105,243 | 10/1963 | Kampfe et al. | 28/147 X |
| 3,560,313 | 2/1971 | Herkimer | 428/4 |
| 3,854,178 | 12/1974 | Montoya | 428/4 X |
| 4,369,215 | 1/1983 | Offen et al. | 28/147 X |
| 4,605,584 | 8/1986 | Herr, Jr. et al. | 428/142 |
| 4,974,429 | 12/1990 | Ferrara | 428/28 X |
| 5,052,059 | 10/1991 | Speer | 428/4 X |
| 5,079,046 | 1/1992 | Kessler | 428/4 |

*Primary Examiner*—Henry F. Epstein
*Attorney, Agent, or Firm*—Leon Gilden

[57] ABSTRACT

A wrist pom is utilized by individuals in cheerleading and the like, to include an elastomeric tubular sleeve having a forward annular end receiving a collar therewithin, wherein the collar has fixedly secured thereto an annular array of elongate, flexible tassel webs at rear distal ends of each web. A modification of the invention includes a squeeze bulb member mounted to the sleeve to provide for selective projection of glitter particles formed of reflective material for an enhanced visual display in use of the organization.

2 Claims, 4 Drawing Sheets

WRIST POMPON STRUCTURE

BACKGROUND OF THE INVENTION

1. Field of the Invention

The field of invention relates to cheerleading apparatus, and more particularly pertains to a new and improved wrist pom organization mounted about an individual's wrist to unencumber an individual's hands in a cheerleading event.

2. Description of the Prior Art

Pompoms of various types are utilized in cheerleading events, and typically, the pompoms are manually manipulated and secured. To permit freedom from grasping of such pompom structure, the instant invention attempts to overcome deficiencies of the prior art by providing a sleeve member mounting elongate tassels therefrom to permit utilization of the hands for manipulating various other cheerleading components, such as batons and the like.

Prior art pompom structure and its production is indicated in the U.S. Pat. No. 3,854,179 to Montoya.

U.S. Pat. No. 4,605,584 to Herr, Jr., et al. sets forth reflective sheet material for utilization in reflective patterns.

U.S. Pat. No. 4,974,429 to Ferrara sets forth a combined bracelet and pendant structure.

As such, it may be appreciated that there continues to be a need for a new and improved wrist pom organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cheerleading apparatus now present in the prior art, the present invention provides a wrist pom organization wherein the same mounts an annular array of tassels at a forward end of an elongate elastomeric sleeve for securement about an individual's wrist arranged with the tassels projecting forwardly and beyond the individual's hands. As such, the general purpose of the present invention, which will be described subsequently in greater detail, is to provide a new and improved wrist pom organization which has all the advantages of the prior art cheerleading apparatus and none of the disadvantages.

To attain this, the present invention provides a wrist pom utilized by individuals in cheerleading and the like, to include an elastomeric tubular sleeve having a forward annular end receiving a collar therewithin, wherein the collar has fixedly secured thereto an annular array of elongate, flexible tassel webs at rear distal ends of each web. A modification of the invention includes a squeeze bulb member mounted to the sleeve to provide for selective projection of glitter particles formed of reflective material for an enhanced visual display in use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrist pom organization which has all the advantages of the prior art cheerleading apparatus and none of the disadvantages.

It is another object of the present invention to provide a new and improved wrist pom organization which may be easily and efficiently manufactured and marketed.

It is a further object of the present invention to provide a new and improved wrist pom organization which is of a durable and reliable construction.

An even further object of the present invention is to provide a new and improved wrist pom organization which is susceptible of a low cost of manufacture with regard to both materials and labor, and which accordingly is then susceptible of low prices of sale to the consuming public, thereby making such wrist pom organizations economically available to the buying public.

Still yet another object of the present invention is to provide a new and improved wrist pom organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
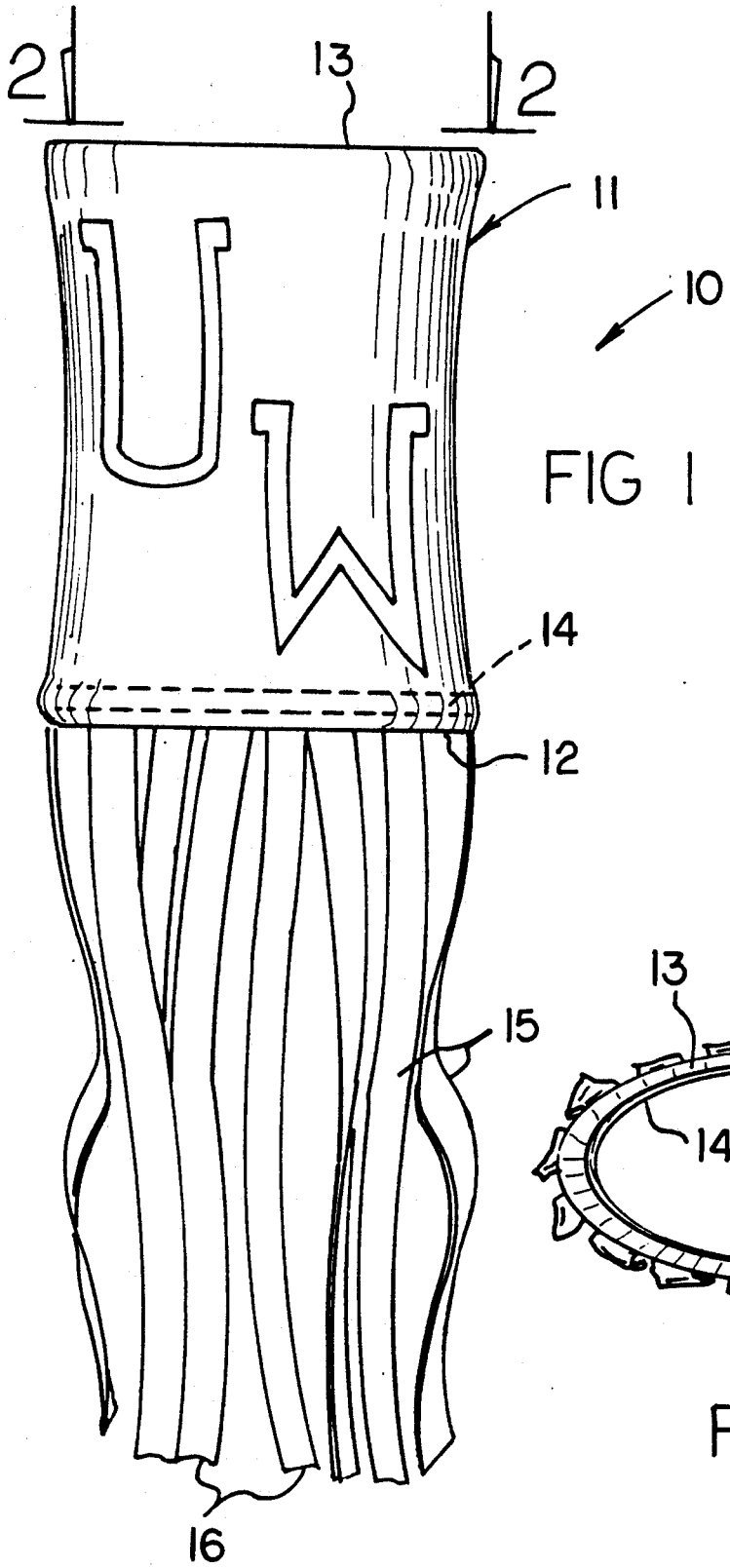
FIG. 1 is an orthographic view of the instant invention.

With reference now to the drawings, and in particular to FIGS. 1 to 8 thereof, a new and improved wrist pom organization embodying the principles and concepts of the present invention and generally designated by the reference numerals 10 and 10*a* will be described.

Figure 2:
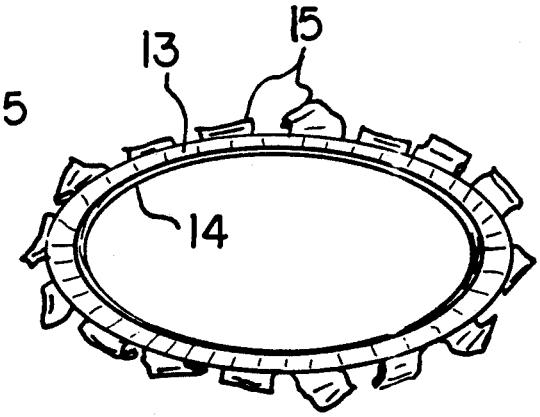
FIG. 2 is an orthographic view, taken along the lines 2—2 of FIG. 1 in the direction indicated by the arrows.

More specifically, the wrist pom organization 10 of the instant invention essentially comprises an elastomeric tubular sleeve 11 having an annular sleeve forward end 12 spaced from and in a generally parallel relationship relative to an annular sleeve rearward end 13. A torroidal collar 14 is mounted within the sleeve adjacent the forward end 12 having a plurality of elongate flexible tassel webs 15 mounted thereto. The tassel webs each include a tassel free forward distal end 16 spaced from the collar 14, and a tassel rearward end fixedly mounted to the collar 14. The tassels are coextensively mounted about the collar in an annular array, such as indicated in FIG. 2 for example.

In this manner, a cheerleader and the like may avail themselves to manually manipulate other visual aids in a cheerleading event as the pompom type structure is mounted to the sleeve structure as illustrated. It should be further noted that logo designations of various types are arranged for imparting by various manner to the exterior surfaces of the sleeve structure. Colorations befitting desired designations, such as school colors and the like, are utilized in a coloration of the tassels as well as the sleeve.

The organization as illustrated in FIG. 1 is secured either by sewing, adhesives, or mechanical fastening in adjacency to the sleeve forward end 12.

Figure 6:
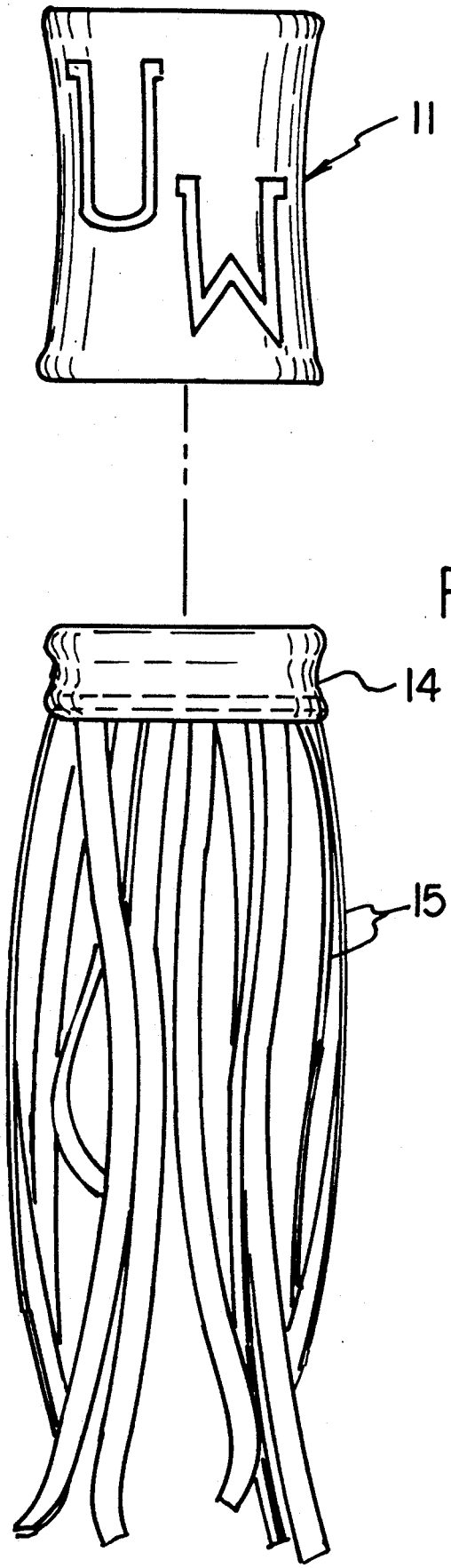
FIG. 6 is an orthographic view of the invention illustrating a separable collar mounting the tassels thereto.
Figure 7:
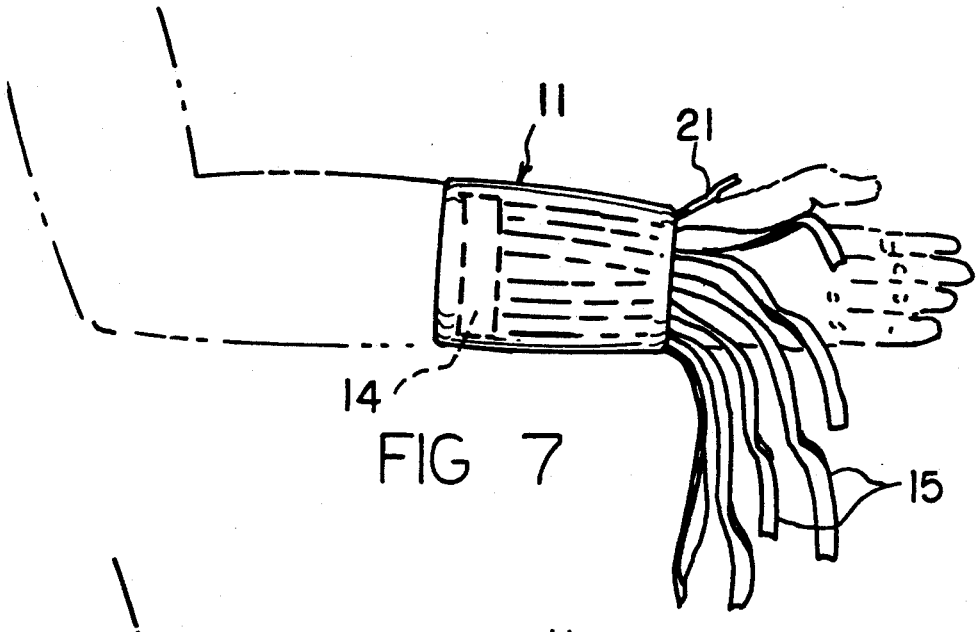
FIG. 7 is an orthographic view of the collar in a rearward orientation relative to the sleeve.
Figure 8:
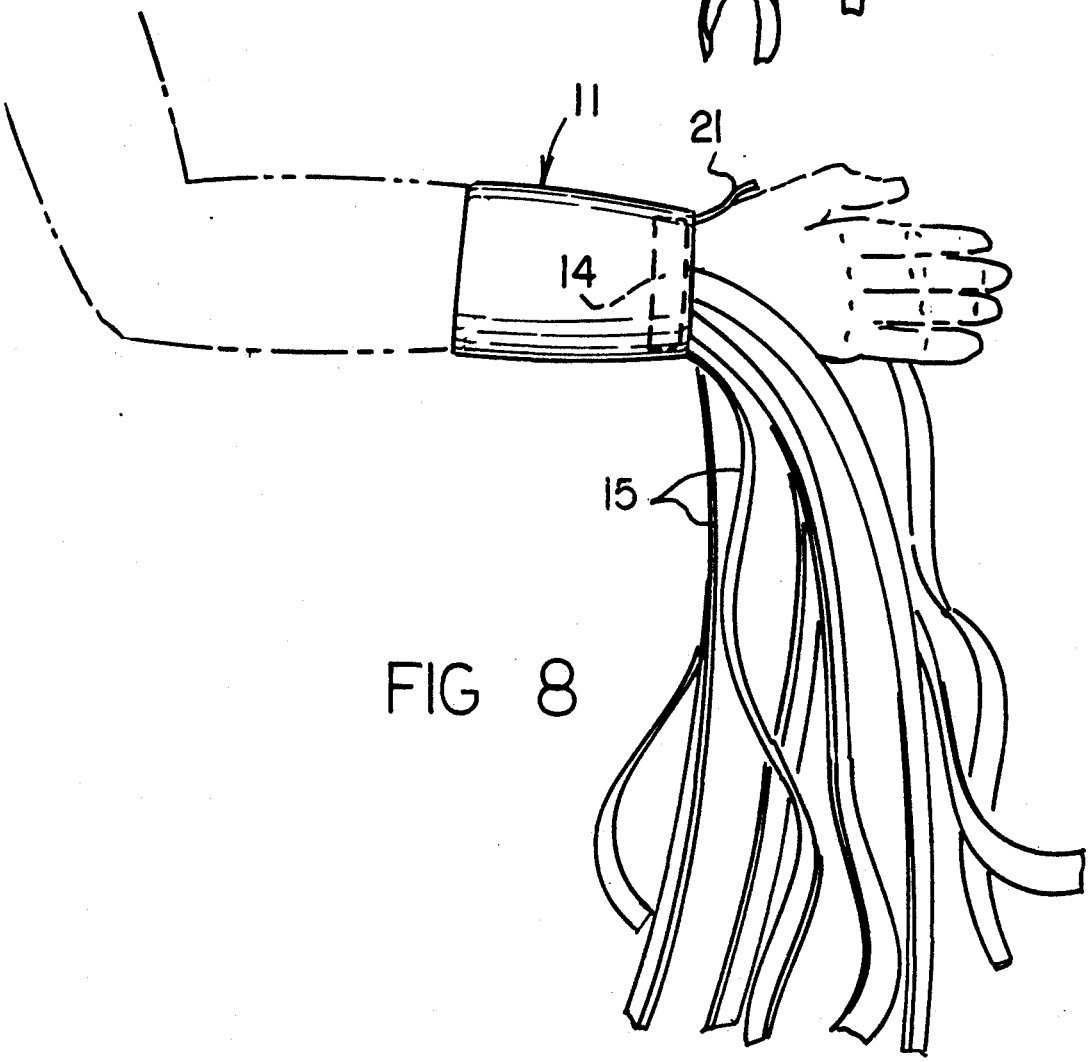
FIG. 8 is an orthographic view of the collar in a forward orientation relative to the sleeve.

The FIGS. 6–8 indicate the use of the collar 14 arranged for adjustable positioning along the interior surface of the sleeve 11, as illustrated in FIGS. 7 and 8, to permit variance of tassel length relative to an individual's hand when utilizing the sleeve. It should be noted accordingly that the collar is typically oriented parallel relative to the forward and rear ends of the sleeve structure to properly orient the tassel webs in use.

Figure 3:
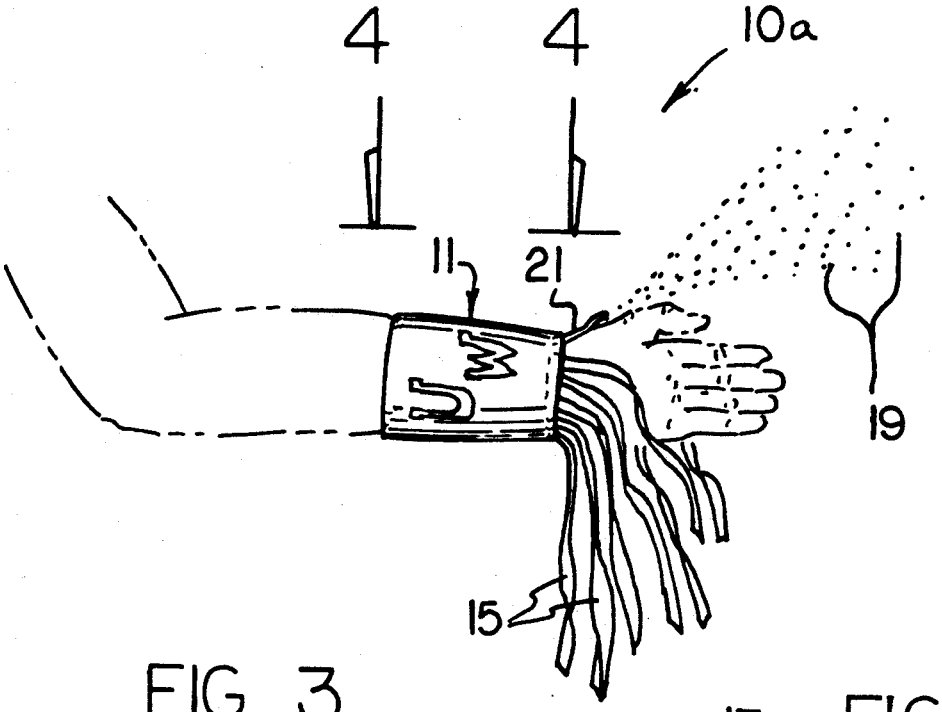
FIG. 3 is an orthographic side view of a modified aspect of the invention in use.
Figure 5:
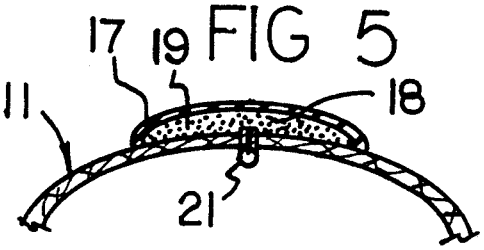
FIG. 5 is an orthographic view, taken along the lines 5—5 of FIG. 4 in the direction indicated by the arrows.
Figure 4:
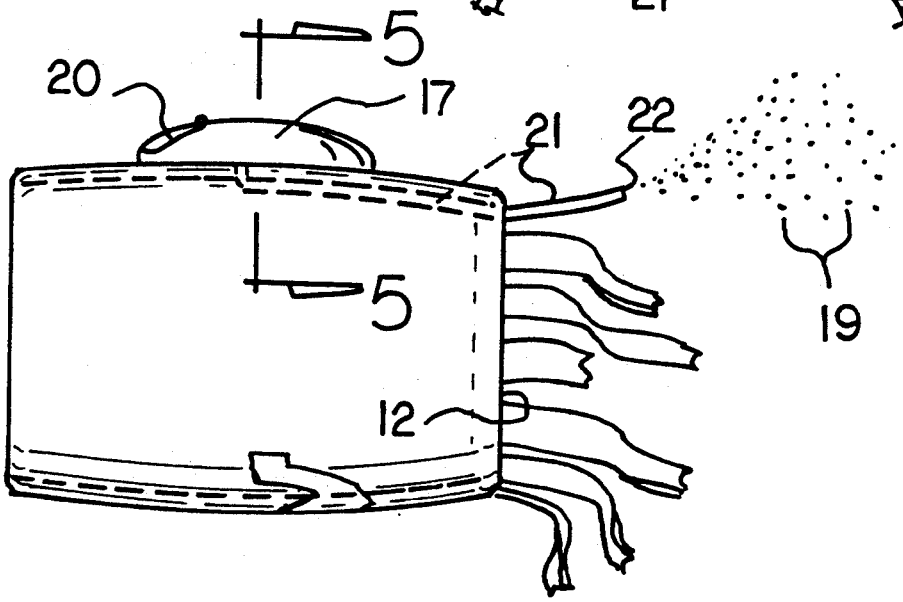
FIG. 4 is an orthographic view, taken along the lines 4—4 of FIG. 3 in the direction indicated by the arrows.

The FIGS. 3–5 indicate the organization 10*a* to include a squeeze bulb 17 mounted to an exterior surface of the sleeve 11, with a squeeze bulb 17 formed of a shape retentent polymeric material defining a bulb cavity 18 therewithin. A plurality of glitter particles 19 are contained within the bulb cavity and the particles are of a well known type, as exemplified in the U.S. Pat. No. 4,605,584 incorporated herein by reference. A conduit tube 21 is directed in communication projecting into the cavity 18 directed along the interior surface of the sleeve and having a conduit tube forward end projecting beyond the sleeve forward end 12. Manual depressing of the bulb 17 effects projection of such cleared particles from the conduit tube forward end portion for enhanced visual display in a cheerleading event. A door 20 is arranged for securement to the exterior surface of the bulb to permit access to the interior cavity of the bulb for replenishment of the particles 19 for use in subsequent events.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A wrist pompom structure, comprising,
   an elongate elastomeric tubular sleeve, the sleeve having a sleeve forward annular end spaced from and parallel a sleeve rearward annular end, and
   a torroidal collar mounted within the sleeve, and
   a plurality of elongate flexible tassel webs secured to the collar, the tassel webs each including a forward distal end and a rear distal end, each rear distal end secured to the collar in a continuous annular array extending forward of the collar and the sleeve, and
   the collar is slidably positioned within the sleeve in a complementary relationship within the sleeve.

2. A wrist pompon structure as set forth in claim 1 wherein the sleeve includes an outer wall extending between the forward annular end and the rearward annular end, and a squeeze bulb mounted to the wall between the forward annular end and the rearward annular end, the squeeze bulb having a squeeze bulb cavity therewithin, and the squeeze bulb formed of a shape retentive polymeric material, and a plurality of glitter particles contained within the cavity, and the squeeze bulb including a door mounted to the bulb to permit selective refilling of said glitter particles within the cavity, and a conduit tube, the conduit tube including a first end directed into the cavity, with the conduit tube extending along an interior surface of the sleeve projecting forwardly and beyond the forward annular end, whereupon manual depressing of the bulb effects projection of said particles from the conduit tube forwardly of the forward annular end of the sleeve.

* * * * *